United States Patent [19]

Watkins

[11] Patent Number: 5,061,919

[45] **Date of Patent: * Oct. 29, 1991**

[54] COMPUTER GRAPHICS DYNAMIC CONTROL SYSTEM

[75] Inventor: Gary S. Watkins, Salt Lake City, Utah

[73] Assignee: Evans & Sutherland Computer Corp., Salt Lake City, Utah

[ * ] Notice: The portion of the term of this patent subsequent to Sep. 4, 2007 has been disclaimed.

[21] Appl. No.: 345,862

[22] Filed: May 1, 1989

Related U.S. Application Data

[63] Continuation-in-part of Ser. No. 256,335, Oct. 11, 1988, Pat. No. 4,954,819, which is a continuation of Ser. No. 68,287, Jun. 29, 1987, abandoned, which is a continuation of Ser. No. 734,923, May 16, 1985, abandoned.

[51] Int. Cl.[5] ..... G09G 1/06

[52] U.S. Cl. ..... 340/721; 340/724; 340/299

[58] Field of Search ..... 340/721, 726, 724, 723, 340/750, 747, 799, 734; 364/521

[56] References Cited

U.S. PATENT DOCUMENTS

| | | | |
|---|---|---|---|
| 4,642,790 | 2/1987 | Minshull et al. | 340/724 |
| 4,663,617 | 5/1987 | Stockwell | 340/724 |
| 4,769,762 | 9/1988 | Tsujido | 340/721 |
| 4,794,386 | 12/1988 | Bedrij et al. | 340/724 |
| 4,954,819 | 9/1990 | Watkins | 340/721 |
| 4,959,803 | 9/1990 | Kiyohara et al. | 340/750 |

*Primary Examiner*—Ulysses Weldon
*Assistant Examiner*—Xiao M. Wu
*Attorney, Agent, or Firm*—Nilsson, Robbins, Dalgarn, Berliner, Carson & Wurst

[57] ABSTRACT

For a raster-scanned, video display apparatus, individual pixel display data is stored in a double image frame buffer. A valid count buffer then holds a count for each pixel. Current valid counts are stored, as at times of image buffer updating which updating includes storing display data changes and a fraction of the total display (background). At times of display, current counts from the count buffer are tested against valid counts as stored for each pixel in the valid count buffer to determine the selection of display data from the image frame buffer or alternate background data. A window frame buffer resolves the display into windows that are accommodated by the system with valid counts for each window.

17 Claims, 4 Drawing Sheets

FIG. — 1
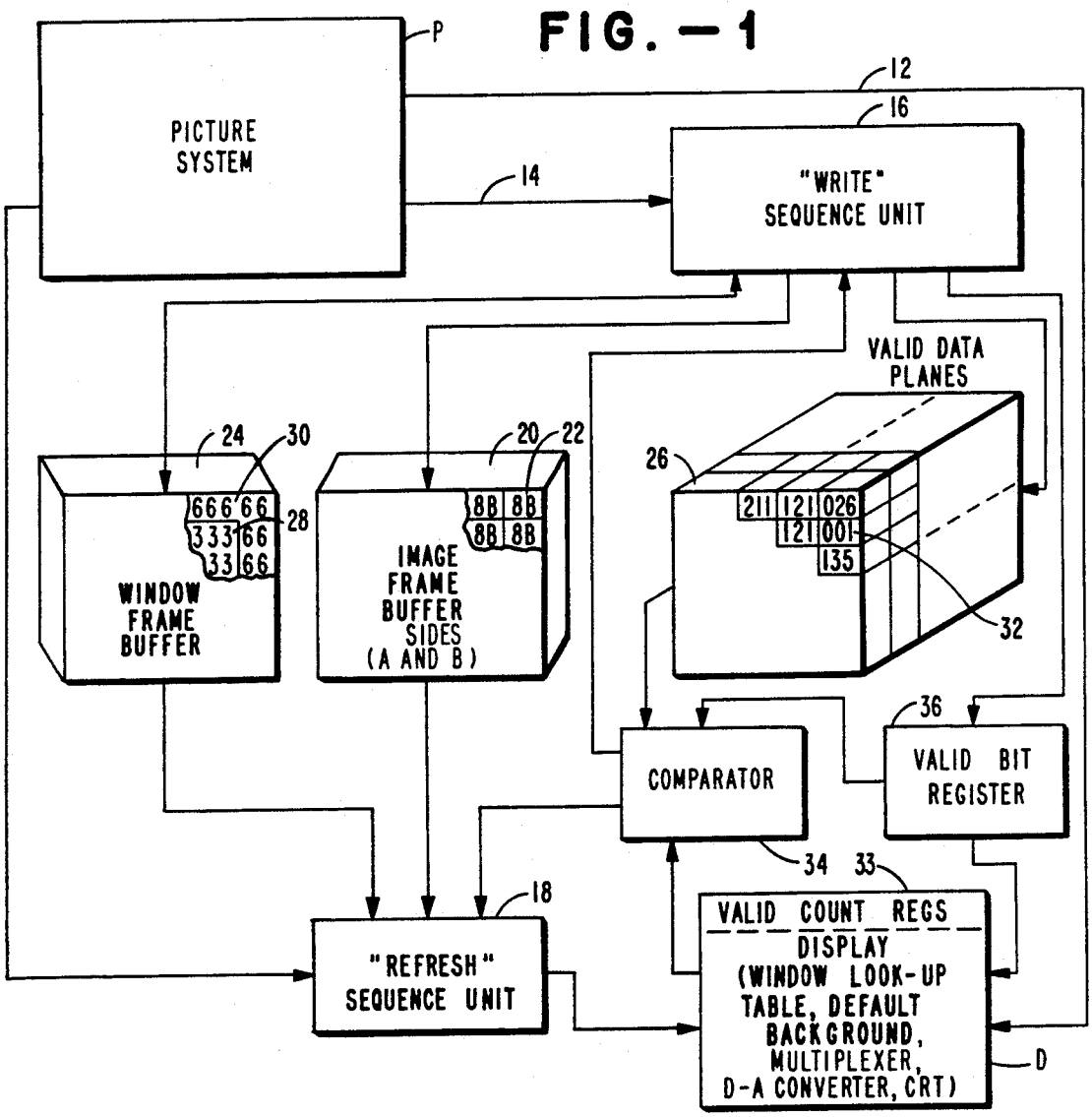
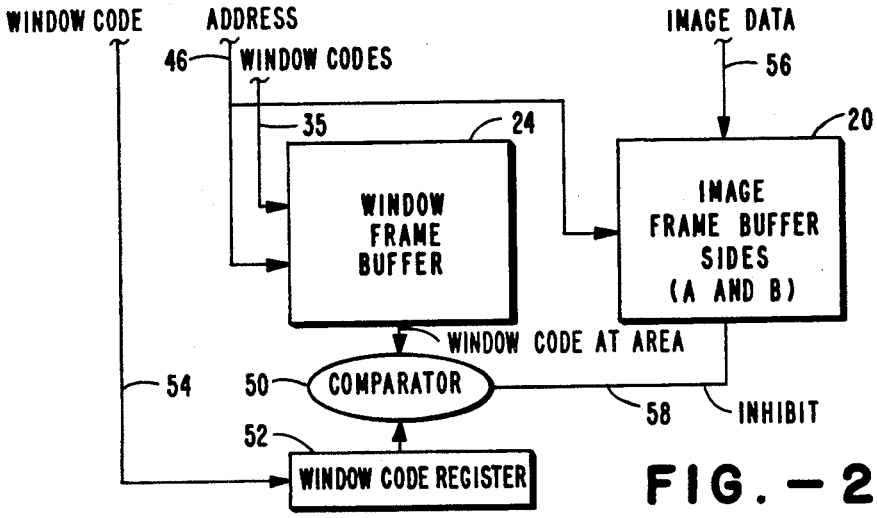
FIG. — 2

COMPUTER GRAPHICS DYNAMIC CONTROL SYSTEM

RELATED SUBJECT MANNER

This is a continuation-in-part of application Ser. No. 256,335 filed Oct. 11, 1988, and entitled "Computer Graphics Windowing System For The Display Of Multiple Dynamic Images", now U.S. Pat. No. 4,954,819 issued Sept. 4, 1990, which was a continuation of application Ser. No. 068,287 filed June 29, 1987, and entitled "Computer Graphics Windowing System For The Display Of Multiple Dynamic Images" which was a continuation of application Ser. No. 734,923 filed May 16, 1985, and entitled "Computer Graphics Windowing System For The Display Of Multiple Dynamic Images".

BACKGROUND AND SUMMARY OF THE INVENTION

Computer graphics systems capable of providing dynamic displays (motion pictures) are well known in the prior art. Typically such displays are raster scanned on a video display apparatus as a cathode ray tube (CRT). To accomplish such displays with smoothly moving objects, it is necessary to frequently refresh the display with a new image. For example, to avoid flicker and depict smooth movement, a fresh display must be shown every one-twentieth to one-sixtieth of a second. Consequently, display data represented by signals, must be effectively developed, allocated and managed. Traditionally, such operations have involved compiling a display file from an image generator, as treated in the book, PRINCIPLES OF INTERACTIVE COMPUTER GRAPHICS, published 1979 by McGraw-Hill, Inc., by William M. Newman and Robert F. Sproull; specifically see Chapter 8.

In prior computer graphics systems, image data indicating color and intensity for each picture element (pixel) has been assembled for display using a so-called "double-buffered display frame buffer". Note that the data might take the form of multiple-digit numerical values representing the intensity and color for each pixel. Essentially, while representative image signals for a picture are being provided from one side of the frame buffer (as to drive a CRT display) the other side of the frame buffer is cleared of previous data and rewritten with fresh data for the next display picture. The roles of the two frame buffer sides are reversed cyclically to provide image signals to the display apparatus in a rapid sequence. The double buffer technique has been effective in the past, particularly when the complete image (complete display of a screen) is treated as a single viewing window. However, a need has existed for more effectively clearing and rewriting data, as for selective display.

Picture systems have been developed that are capable of providing image signals in rapid sequence that are representative of several different views concurrently. Accordingly, image data is available for several different dynamic images as in a split screen or windowed display. Managing the data for refreshing such a multiple-window dynamic display involves added complications. In that regard, consider the use of a traditional double-buffer frame buffer. Alternatively, the sides of the frame buffer receive data composed for display then deliver the data in ordered scanning sequence. After supplying data, each side traditionally has been cleared to receive new data. However, selective clearing provides distinct advantages and a need has existed for improved systems in that regard.

Summarizing to some extent, a need exists for an improved system for managing image data preparatory to driving a dynamic display that may include distinct windows. Specifically, a need exists for a system capable of performing the following operations: (1) the operation of selectively writing only to the window of interest in a display and not writing in other windows, even where one window partially overlays another; (2) the operation of selectively and rapidly clearing a window of interest partly or fully without clearing the complete screen; (3) the operation of swapping the frame buffer corresponding only to a window of current interest; and (4) the selection of a given area within a given window for display, whether data to be displayed on the screen comes from, (a) a default background color for the window, (b) one or the other side of the frame buffer, or (c) both buffer sides together (to yield more bits per pixel for nondynamic pictures).

In general, the dynamic display system of the present invention is capable of accomplishing the above operations in an expedient and economical manner. An image frame buffer stores image data which is entered and discharged in accordance with data registered in a window frame buffer and a plurality of valid data storage planes defining counters. In the disclosed embodiment, the window frame buffer registers window codes which define windows with respect to the contents of the image frame buffer. The valid data planes hold valid count value indications of individual area data of current interest. Generally, the window frame buffer defines windows with respect to the image frame buffer and the valid data planes define individual areas, e.g. pixels, of current interest with respect to the contents of the image frame buffer. That is, counts in the valid data planes indicate data and background for display and rewrite. A valid counter or register provides current valid counts which are tested against the pixel-related counts in the valid data planes. Individual pixel coincidence indicates the pixel data in the frame buffer is valid. Accordingly, the data is used in the display. Invalid data prompts the display of background data. As disclosed below, the system may provide valid counts for each of several windows.

BRIEF DESCRIPTION OF THE DRAWINGS

In the drawings, which constitute a part of this specification, an exemplary embodiment of the invention is set forth as follows:

FIG. 1 is a block diagram of a system constructed in accordance with the present invention;

FIG. 2 is a block diagram of a component of the system as represented in FIG. 1;

DESCRIPTION OF THE ILLUSTRATIVE EMBODIMENT

Figure 4:
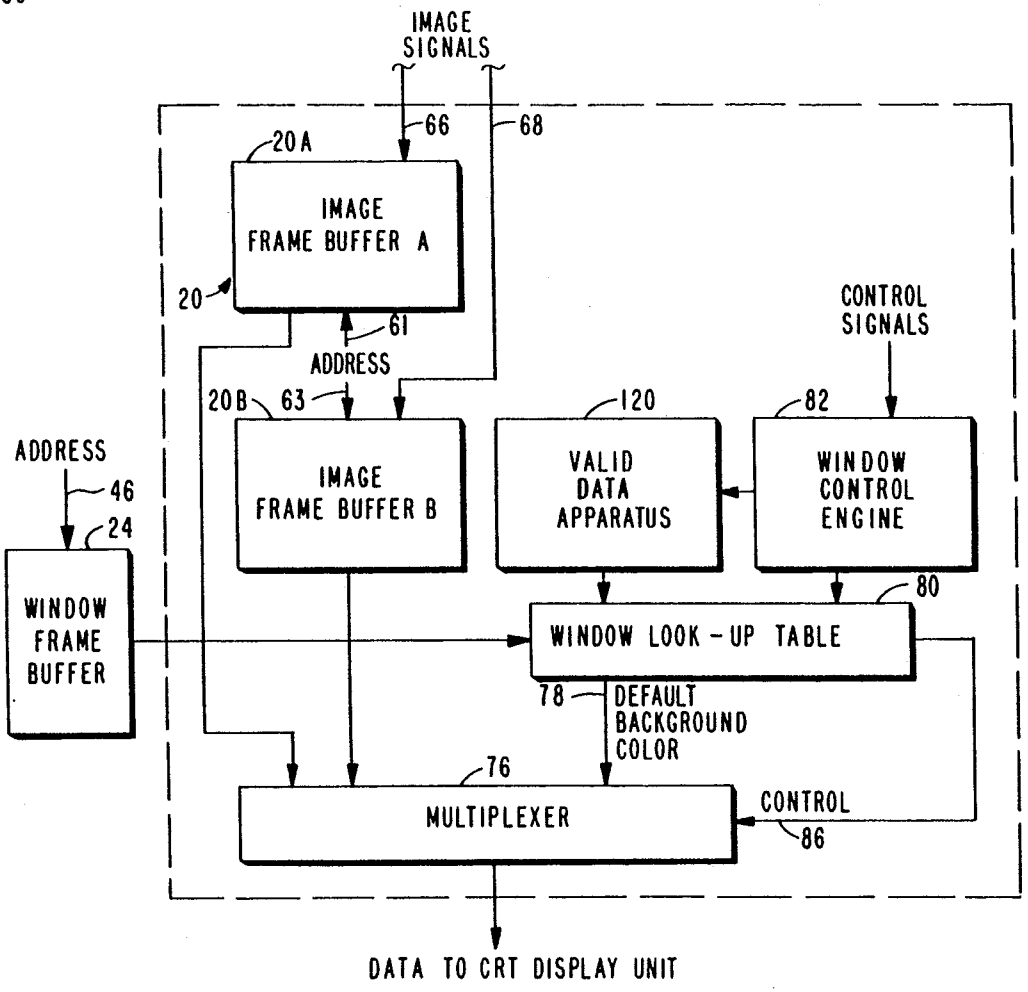
FIG. 4 is a block diagram of another component of the system of FIG. 1.

As indicated above, a detailed illustrative embodiment of the present invention is disclosed herein. However, image displays, data formats, component structures, memory organization, and other elements in accordance with the present invention may be embodied in a wide variety of forms some of which may be quite different from those of the disclosed embodiment. Consequently, the specific structural and functional details disclosed herein are merely representative; yet in that regard, they are deemed to afford the best embodiment for purposes of disclosure and to provide a basis for the claims herein which define the scope of the present invention.

Referring initially to FIG. 1, a picture system P is represented (upper left) for providing elemental image signals to drive a display apparatus D (lower right) incorporating a display unit (CRT) along with final signal processing structures. The picture system P provides picture signals including synchronizing signals and image signals indicative of elemental areas, e.g. pixels in a display composed according to a scan pattern. Managed and composed in accordance with the synchronizing signals, the image signals drive the display apparatus D to accomplish dynamic images.

In general, picture systems for developing picture signals are well known in the prior art and in that regard, the Picture System II is a form of such apparatus commercially available from Evans & Sutherland Computer Corporation. The apparatus is broadly described in the above-referenced book, PRINCIPLES OF INTERACTIVE COMPUTER GRAPHICS, see page 423.

In the disclosed embodiment, the picture system P provides picture signals that are managed in accordance with the present invention to drive the display unit D. Accordingly, a display is composed of individual areas, e.g. pixels, treated in a raster scan pattern. Such areas are specified by digital values (eight bits) as with regard to color, light intensity and so on.

In accordance with the disclosed embodiment, signals from the picture system P are managed, e.g. compiled and arranged, for driving the display apparatus D in a raster pattern mode, as to accomplish multiple window displays. In that regard, the composite display may be variously fragmented into windows that are defined as by overlapping rectangles or other shapes. The number, size and shape of the windows may vary; and the display in each window may be either dynamic or static.

The picture system P (FIG. 1) is connected directly to the display apparatus D by a cable 12 carrying synchronizing signals related to deflection, timing, and related operations of the apparatus D.

Image data signals representative of individual image areas or pixels are supplied from the picture system P through a channel 14 to a "write" sequence unit 16. Essentially, the "write" sequence unit 16 manages the movement of image signals into buffers from which such signals are selectively supplied through a "refresh" sequence unit 18. In that fashion, sequential image frames for a dynamic display are provided to the apparatus D.

In accordance herewith, elemental areas in an image may be variously composed and defined. However, with respect to the illustrative embodiment, the elemental areas are treated as individual pixels. Accordingly, image data in the form of pixel signals is stored in an image frame buffer 20 to specify light intensity and color for elemental areas of the display. The image frame buffer 20 may be considered to hold image data in the arrangement of pixel data units 22 similar to the raster scanned arrangement of the display.

Each elemental unit or pixel 22 of image data may comprise eight binary bits. Thus, the elemental storage units 22 are symbolically represented in FIG. 1 as eight bits "8B" and as indicated above, for purposes of convenience may be considered to exist in a positional alignment coinciding to their associated pixels in a display.

Manipulation of data with respect to the image frame buffer 20 involves the content of other storage, specifically a window frame buffer 24 and valid data planes 26. Both the window frame buffer 24 and the valid data planes 26 may be conveniently treated as an arrangement of memory elements coinciding to the display area, e.g. scan pixel array of the display. In that regard, the window frame buffer 24 defines the current windows of a display in accordance with registered window codes. For example, a window 28 is defined by an array of window code "3" numerals. A window 30 for the display is indicated by an array of window code "6" numerals. Such window code numerals thus define on an elemental basis coinciding to pixels. Note that the figures herein are not in scale, however in any event, the window codes (numerals) in the window frame buffer 24 specify the window format for the ultimate display by the apparatus D.

The image frame buffer 20 includes sides A and B. As indicated above, two-sided frame buffers are well known and have been used in traditional display systems. In operation, while one side supplies image data to refresh a display unit, the other side receives image data written for the next frame of the display. After each operation, the functions are swapped. In accordance herewith, control of the image frame buffer 20 is enhanced, for example, so that the frame sides A and B may be swapped in relation to windows of display.

Further selectivity in operating the image frame buffer 20 is accomplished by the operation of the valid data planes 26 which essentially comprise an array of counters as illustrated. In general when image data is being supplied to or from the image frame buffer 20, the valid data planes 26 designate the data units 22 either as valid or invalid. Then only data units 22 that are designated as "valid" are used.

In one aspect hereof, the valid data planes 26 accommodate the operation of the image frame buffer 20 to stringent time demands by enabling selective display and by avoiding bulk clearance of image data. Accordingly, preparatory to writing in a side of the image frame buffer 20, it is not bulk cleared. Rather, fresh data (pixel image data) is written only in the locations (units 22) to be used during the coming display. Such valid locations are designated by the presence of specific numerical counts in valid data planes 26. Specifically, an array of numerical values is stored in sections 32 of the planes 26. Individual registers or sections 32 in the array of planes 26 identify or coincide with the array of units 22 in the image frame buffer 20. The presence of a specific numerical value or count (e.g. "121" as illustrated) in associated sections 32 of the valid data planes 26 indicates that the coinciding elements 22 in the image frame buffer contain valid pixel data. Conversely, any other count, as 211, 026, 001, 135 and so on, may designate the coinciding pixel data in the frame buffer 20 to be invalid, as to accomplish the display of background.

In the designation of valid and invalid data, a specific value or count ("121" in the above example) is provided from valid count registers 33 (structurally a look-up table) comprising part of the display apparatus D as disclosed below. Essentially, a valid count from a valid count register 33 is tested by a comparator 34 against numerical values from the sections 32 of the valid planes 26.

As the test proceeds pixel-by-pixel, coincidence between the valid count from the registers 33 and a numerical value from the sections 32 of the valid data planes 26 (for a pixel) indicates valid data for the pixel in the image frame buffer 20.

With regard to the disclosed embodiment, the test or selection is somewhat further complicated by the fact that the display is windowed and the image frame buffer has two sides as explained above. The operation is described in detail below; however, it will be noted that the comparator 34 is coupled to a valid bit register 36 comprising a single array or plane of binary storage to account for the two sides of the image frame buffer 20.

Recapitulating to some extent, the sides of the frame buffer 20 alternately receive and provide image pixel signals. However, the operation with respect to each pixel is determined by the contents of the window frame buffer 24, the valid data planes 26, the valid data counts (registers 32) and the valid bit register 36. For example, if data for a pixel is determined to be "valid" it is displayed; otherwise secondary or background data is displayed.

Functionally, the window frame buffer 24 defines the windows. The valid data planes 26 distinguish valid data for each pixel of each window, depending on the valid count (registers 33). The valid bit (register 36) accounts for the sides A and B of the frame buffer 20 with variations in the valid data planes 26.

Figure 3A:
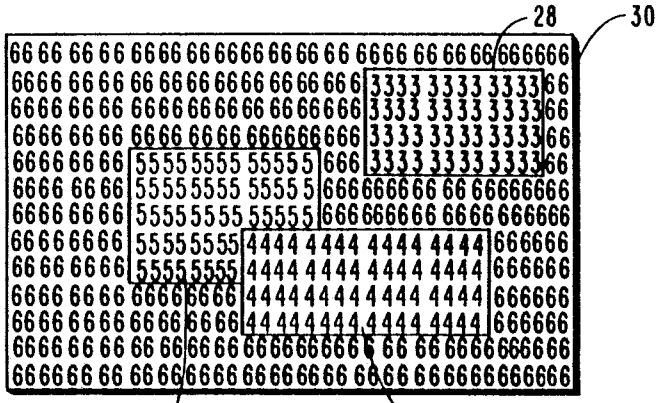
FIGS. 3A and 3B are diagrammatic, unproportioned display representations illustrative of one aspect of operation of the system of FIG. 1.
Figure 3B:
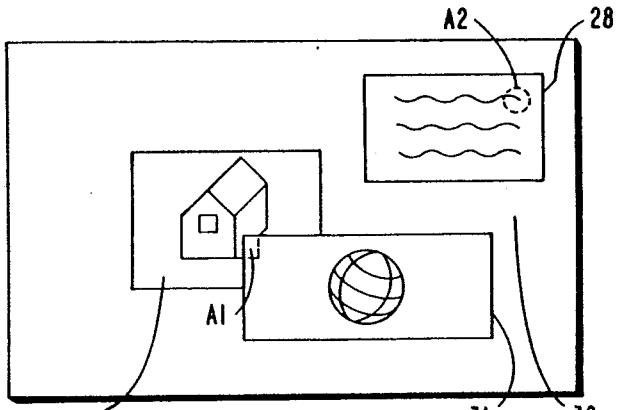

In view of the above introductory material, consider now some general operations of the system of FIG. 1. Initially, assume that a window format is stored in the window frame buffer 24. An exemplary format expanding on the windows 28 and 30 (FIG. 1) is illustrated in FIG. 3A. In that regard, the window codes are illustrated as registered in the window frame buffer 24 to define windows 28 and 30 along with two additional windows 31 and 35. A representative display embodying the windows of FIG. 3A is illustrated in FIG. 3B. In that regard, note that the window code "3" defines a window 28 showing lines. The window code "4" designates a window 31 carrying a sphere and overlapping a window 35 defined by window codes "5" showing a shed. Note that the background window 30 is designated by window codes "6".

With the window codes from the picture system P stored, as assumed, in the window frame buffer 24 (FIG. 1), the system next writes image data pixel-by-pixel in the image frame buffer 20 (FIG. 1). Image data, in the exemplary form of eight bit words, is stored in units 22 of the image frame buffer 20 as allocated for display in the pixel locations as illustrated. Associated with the image data in the image frame buffer 20 is the valid data in the valid data planes 26. Note that the pixel sections 32 in the valid data planes 26 are sequenced in writing and display operations as disclosed in detail below. A coincident count value at a pixel location in the planes 26 with the current valid count in a register 32 designates valid pixel data in the related pixel section 22 in the frame buffer 20. Conversely, lack of such coincidence indicates that the coinciding pixel image data in the image frame buffer 20 is not of present concern in the display. Accordingly, a pixel unit 22 designated as invalid may be displayed with background color. Thus, the stick figures (FIG. 3B) can be represented by a relatively small amount of image data for areas (pixels) commanding the use of a relatively small number of pixel units 22 (FIG. 1) in the image frame buffer 20. Again, the background for such stick figures is provided by default under control of the valid data planes 26 as explained in greater detail below.

In view of the above explanation, it is apparent that the valid data planes 26 enable the use of less than all of the storage units 22 in the image frame buffer 20 for any specific object display. However, in that regard, the relationships between signals in the individual valid data planes 26 and image data in the image frame buffer 20 changes during the course of a dynamic image display. Again, while one side of the frame buffer 20 is being written for display, the other side is being read to display. Both write and read operations are selective, both with regard to windows and individual pixels. To consider a portion of the operation with respect to the windows as defined by the window frame buffer 24, reference will now be had to FIG. 2 wherein the image frame buffer 20 is again represented along with the window frame buffer 24 and part of the write sequence unit 16.

FIG. 2 illustrates structure in the "write" sequence unit 16 (FIG. 1) and the method for selectively writing or entering image data in the buffer 20. Assume that the window frame buffer 24 (FIG. 2) has been loaded with window codes, for example as illustrated in FIG. 3A. Such codes are simply loaded into the buffer 24 from the picture system through a line 35.

With respect to the illustrations of image data in FIG. 3, it is to be understood that a simplistic format is shown involving relatively few pixels of relatively large size. In an operating system, the display areas or pixels would be much smaller and far greater in number. However, the format has been simplified for purposes of illustration and explanation.

With the window frame buffer 24 (FIG. 2) loaded as shown in FIG. 3A, a pixel address is specified from the picture system P through a line 46 commanding both the image frame buffer 20 and the window frame buffer 24 to a specific pixel. Note that the line 46 is encompassed within the channel 14 (FIG. 1) so that the picture system provides individual pixel addresses in sequence. Of course, various arrangements may be employed; however, in one format the pixel-designating locations in the window frame buffer 24 are designated and considered in a raster scan pattern.

In a sequence as addressed, window codes from the window frame buffer 24 are supplied to a comparator 50 which also receives a window code from a window code register 52. Codes are supplied to the register 52 from the picture system P (FIG. 1) through a line 54. Thus, window codes for individual image areas are tested in the operation of loading the image frame buffer 20 with image data.

Generally, loading the image frame buffer 20 is accomplished by selecting a particular window code, e.g. window 35 designated by window code "5" (see FIG. 3A) and testing that code against areas (pixels) defined in the window frame buffer 24. Note that the area of overlap between the windows 31 and 35 (designated respectively by window codes "4" and "5") has been assigned the code "4" indicating that the areas will be displayed as illustrated in FIG. 3B.

To consider a sequence of operation, assume that a fresh view of the shed (window 35) is to be written into the image frame buffer 20 (FIG. 2). As indicated (FIG. 3A), the window 35 is represented by the window code "5". For each item of image data (eight bits manifesting a pixel) that might be written into the image frame buffer 20, there is a test against the window code "5". If a match occurs, the data is written into the image frame buffer 20. If no match occurs (as in the case where the window 31 overlaps the window 35), then the data representative of an area in the window 35 is blocked, i.e. inhibited from being written in the image frame buffer 20.

Specifically, the window code, e.g. window code "5", is set in the window code register 52. Thereafter, address signals are supplied to the line 46 specifying areas for each location sequentially in the window frame buffer 24 and the image frame buffer 20. Consequently, as the window frame buffer 24 is addressed, window codes representative of specific areas are supplied to the comparator 50 to be tested against the window code contained in the register 52. As indicated, upon coincidence, the image data is loaded into the image frame buffer 20 at the address specified in the line 46. If the test does not indicate a favorable comparison, then a signal generated by the comparator 50 is supplied through a line 58 to inhibit the acceptance of the image data in the buffer 20. Accordingly, in one aspect, the image frame buffer (side A or side B as currently involved) is loaded with image data coincident with a specific window as defined, e.g. window 35 (FIG. 3B) as defined by the window code "5" in FIG. 3A. The other control aspect involves the valid data planes 26 (FIG. 1) and the resulting selection of image data versus background data.

As described above, the valid data planes 32 are set by the picture system P through the unit 16. For each pixel location where valid data is stored in the image frame buffer 20, a number is set in the valid planes 32 that equals the display valid count, as stored by a select one of the valid count registers 33 (one for each window). In all other pixel locations, the valid planes 32 retain numbers that are not equal to the valid count and, accordingly, related pixels are designed in the image frame buffer 20 as holding invalid data. Accordingly, the window look-up table in the display apparatus D selectively prompts the display of image data (from the frame buffer 20) or background color through a multiplexer.

As the display changes, the valid counts change for individual windows. In the disclosed embodiment, the counts may range from "1" to "256", there being eight valid planes 26. As a dynamic display is presented, some clearing is necessary to avoid the consequences of wrap around. That is, as the valid count progresses through a cycle ("1"–"256") ultimately it will return to old numbers in the valid data planes 26. Consequently, unless the frame buffer 20 and the valid data planes 26 are cleared, residual old numbers in the planes 26 will improperly designate "invalid" data as "valid". To avoid such an occurrence, the system clears a fraction of each window during each writing operation both with regard to the frame buffer 20 and the valid data planes 26. Specifically, a fraction ("1/256th") of the window scan lines is cleared to background with each writing of a window. Thus, after "256" update operations designated as valid data counts, a window is cleared at least once. The operation is illustrated in FIG. 5.

Figure 5A:
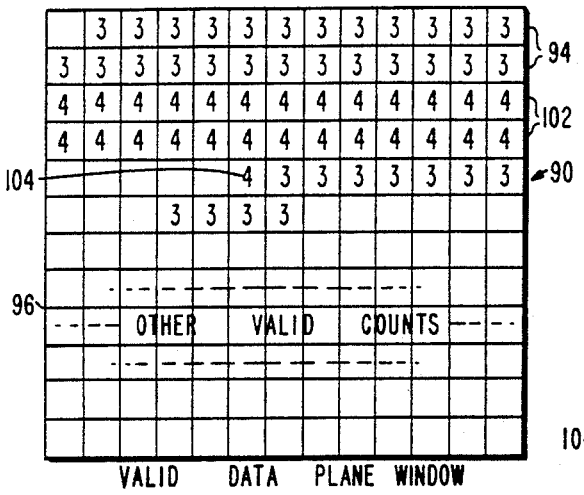
FIGS. 5A, 5B and 5C are unproportioned diagrams illustrating the operation of the system of FIG. 1.

Considering an illustrative window in FIG. 5A, the content of the valid data planes 26 is illustrated by a symbolic valid window array 90 (a fragment of the total valid data planes array). Similarly, image arrays 92 and 92B for fragments of the image frame buffer are shown in FIGS. 5B and 5C representing the sides A and B of the image frame buffer.

Figure 5B:
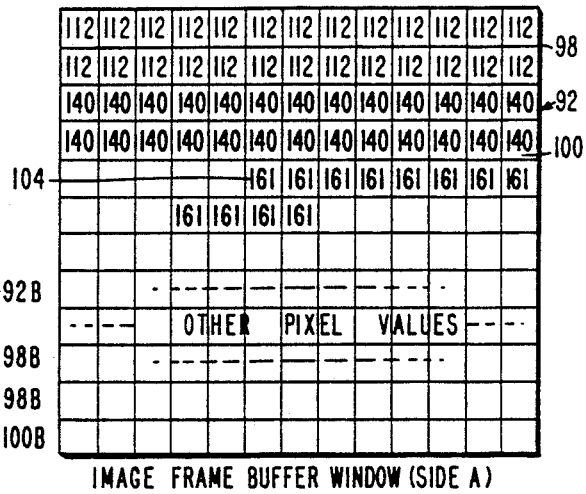

Prior to the instant represented in FIG. 5, the window was refreshed with a valid count of "3" in the array 90 (FIG. 5A) and associated display data "112" in the array 92 (FIG. 5B). Specifically, the top two rows 94 of background were written in the array 90 with a fresh valid count ("3's"). Concurrently, the associated locations 98 in the array 92 were written with fresh image data ("112") (image color and intensity). Additional display image pixel locations were also rewritten. Specifically, valid counts of "3" were written in the image pixels 96 (array 90) and image signal data "161" was written in the pixels 100. Thus, being designated as valid, the display data "112" commanded background display, while the image data "161" commanded an image color and intensity. Other pixel data (various numbers) was specified as "invalid" and prompted background to be displayed.

Figure 5C:
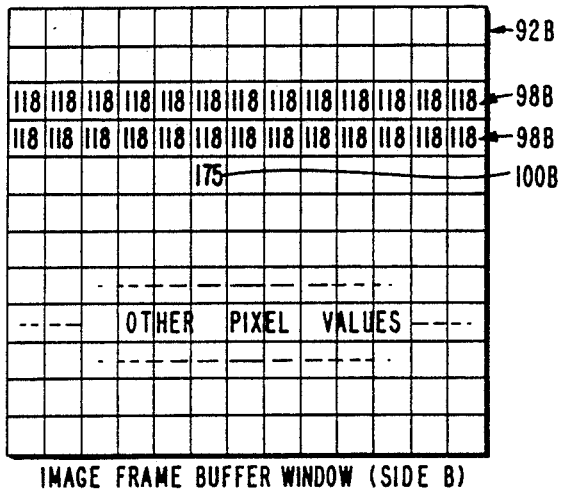

During a subsequent operation (illustrated to be in progress) a new image is shown in the process of being written into side B of the image frame buffer 92B (FIG. 5C). The old image is shown still stored and being displayed from side A of the image frame buffer 92 (FIG. 5B). Specifically, the third and fourth rows 102 of background were written in the array 90 (FIG. 5A) with a valid count ("4's"). Concurrently, the associated locations (FIG. 5C) in the array of side B of the image frame buffer 92B (FIG. 5C) were written with fresh image data ("118") (image color and intensity).

In the subsequent operation an additional pixel as illustrated has just been written at location 104 (FIG. 5A, as indicated by valid count "4"). The associated image data ("175") (image color and intensity) has also just been written into 100B of side B of the image frame buffer 92B (FIG. 5C). Thus, the background designations for data "118" have been stored along with an initial image data value "175". The image data of the previous frame (that is still being displayed) has not been destroyed, but still exists in side A of the image frame buffer 92. Although the valid count at location 104 has changed from "3" to "4", subsequent discussion will show that image data "161" from side A of the image frame buffer will still be displayed.

As a consequence of the above operations, it may be seen that only a fragment of the image frame buffer 20 is active with each rewrite or display operation. Furthermore, the active fragment may be relatively small while affording flexibility of operation.

As explained above with reference to FIG. 1, sides A and B of the image frame buffer 20 are swapped in the functions of receiving written data (display input) and providing refresh data (display output). Consequently, a problem arises with regard to the display input and output cycles when the second valid count ("4's") is being written as depicted in FIG. 5A. The problem is that designations of previous good image data (valid count "3") are changed in the designation of valid planes 26 to the current count ("4") and pixels are designated in the frame buffer 20 as "invalid" (background) while such data is still being displayed.

To consider the system with regard to the identified problem, reference will now be made to FIG. 6 which is a horizontal time plot of events in the system operation. To distinguish the "data in" and "data out" operations, the events are indicated above and below a time line 110, see lines 114 and 116. Horizontal line segments IA indicate operations of the frame buffer side A and line segments IB indicate operations of side B.

A pair of vertical broken lines 112 and 125 indicate buffer swap operations, involving a change for a given window and prompting changes in the valid counts as stored by the registers 33 (FIG. 1). Specifically, with the occurrence of a buffer swap, the "valid count out" becomes the previous "valid count in". Note that at the buffer swap indicated by the broken line 112, the "valid count out" receives "3", the prior "valid count in", see the dashed lines at the center of FIG. 6. Specifically, the drawing shows representations of a "valid count in" and a "valid count out" indicating signal represented counts to enable the single set of valid planes 26 to function in association with the two sides of the frame buffer 20. As illustrated in FIG. 6, the "valid count in" is offset from the "valid count out" by a single count.

While buffer swaps with attendant changes in valid counts (register 33) occur as indicated at times designated by the lines 112 and 123, the valid count and valid bit of individual pixels (registers 32 and 36) are changed in scan sequence. To illustrate, consider the bottom portion of FIG. 6.

Related to the time line 110, a line 127 indicates changes in the valid count for the pixel 104 (FIG. 5) while a line 129 represents concurrent changes in the valid bit for the same pixel 104. Following the buffer swap operation represented by the vertical line 112, a time is designated by an arrow 123 approximating the processing instant for the pixel 104 in the scan sequence. At that instant, the valid count and valid bit both change for the individual pixel 104. Specifically, as illustrated by the line 127, the valid count for the pixel 104 changes from "3" to "4". As illustrated by the line 129, the valid bit for the pixel 104 changes from "0" to "1".

In view of the above explanation, operation of the system now can be summarized on a pixel-by-pixel basis for the alternative display of frame buffer data or background data. Specifically, the operations as performed by the display apparatus D are as follows.

For data output (display)

if, [valid planes = valid count out] (register 32) (register 33), or if, [(valid planes - 1) = valid count out (register 32) (register 33), and if, valid bit is set] (register 36);

then, display data from image frame buffer 20, otherwise display background (from a table in the display apparatus D).

Figure 6:
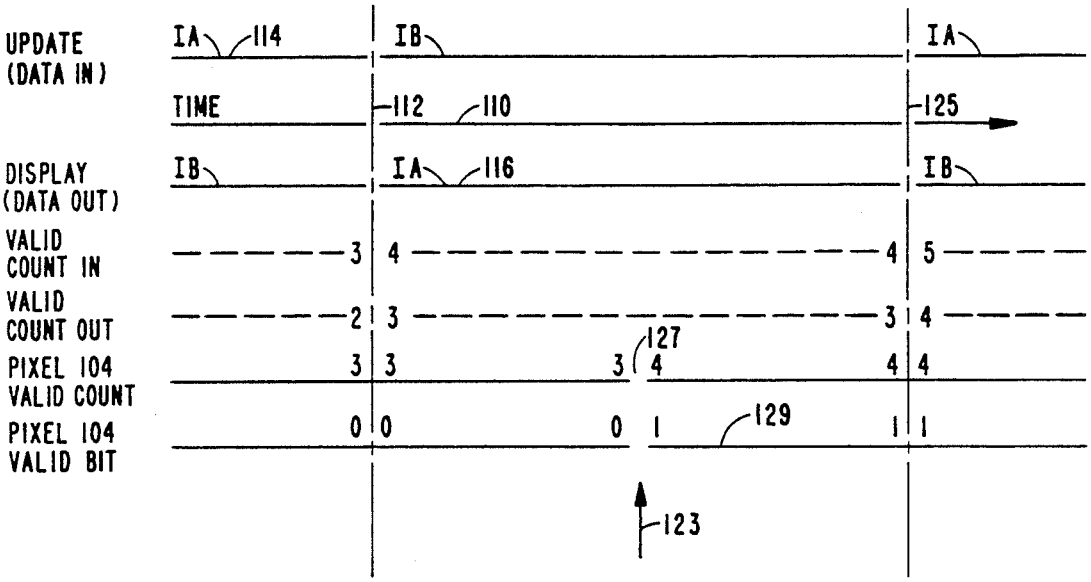
FIG. 6 is a timing diagram illustrative of operations in the system of FIG. 1.

Relating the operations to the example of FIG. 6, assume a time indicated by the arrow 123. The valid count in the assigned count register 33 has changed, indicating a "valid count in" of "4" and a "valid count out" of "3". The image buffer side B receives data as indicated by the line IB. The image buffer side A supplies data for display as indicated by the line IA. Note that the desired image data in the frame buffer side A has not been rewritten and, accordingly, is still supplying data for display wherever the valid count of "3" is still stored in the valid planes according to the equality of the first expression above, specifically:

if [valid planes = valid count out],

Therefore, [3 = 3] is true and image data will be displayed from side A of the image frame buffer.

However, in FIG. 5A, pixel 104 was changed from "3" to "4", thus making the corresponding image data 161 (FIG. 5B) invalid in accordance with the first expression above. To correct this, the pixel valid bit was set when the pixel valid count was changed from "3" to "4" for pixel 104. Then, data is displayed in accordance with the equality of the second expression above:

if [(valid planes - 1) = valid count out and if valid bit is set], therefore, [(4 − 1) = 3 and valid bit is set] is true and image data 161 (FIG. 5B) will still be displayed from side A of the image frame buffer. Invalid data, designated by other (obsolete) counts is disregarded in favor of background data.

Now, consider the operations in the data planes 26 attendant rewriting image data in the frame buffer 20. Here, operations are designated in FIG. 6 by the line IB, beginning at the arrow 123 and the line IA beginning at the arrow 125. The following rules apply.

For data input (writing)

if, previous valid planes = (valid count in -1) (register 32) (register 33), then, set the valid bit and write valid planes with current valid count;

if, previous valid planes = valid count in (register 32) (register 33), then, do not change valid bit (register 36), write valid planes with current valid count;

in all other cases, clear valid bit (reset) and write valid planes with current valid count.

In these operations, the "valid count in" is controlling and based on previous content of the sections 32 in the valid planes 26, pixel-by-pixel, the sections 32 are treated and the pixel array of the valid bit register 36 controlled. Accordingly, the system is prepared for a subsequent display or "data out" operation.

As an aside, however, in the interest of assuring a completely detailed disclosure, a more rigorous specification may be of interest. In that regard, the outline below utilizes notation as follows:

V# Version number in valid planes,
Vv Version number used for update,
Vd Version number used for display,
Vs Fix-bit or valid bit.

In the interests of indicating an alternative, the process of the outline decrements valid counts rather than to increment them as described above. The difference is only one of choice and does not otherwise affect the process.

Initially, let Vd = 1, Vv = 0. Clear entire valid buffer to background color setting valid planes to Vv (V# = Vv) with fix-bit clear (0). Thereafter, follow these rules:

A. Display Rules

If ((V# = Vd) or ((V# = Vv) and Vs)) display pixel data, else display background color.

B. Validating Background Color

Validate a stripe of the virtual screen to the background color. This is a number of scan lines of the virtual screen. (Must be 1/(2**n − 1) of the area of the virtual screen, "n" is number of valid bit planes.) The rule for updating the valid planes for validating background color is:

If ($V\# = Vd$), set fix bit and set ($V\# = Vv$), write pixel data to background color.

else, if ($V\# = Vv$)

don't change fix bits, but write pixel data.

else, clear fix bit and set ($V\# = Vv$), write pixel data to background color.

C. Virtual Screen Update Rules

Update the picture. The following is the rule for updating the valid planes:

If ($V\# = Vd$), set fix bit and set ($V\# = Vv$), write pixel data.

else if ($V\# = Vv$), don't change fix bit, but write pixel data.

else clear fix bit and set ($V\# = Vv$), write pixel data.

D. Swap Image Buffers $Vd = Vv$ $Vv = Vv - 1$ (modulo 256)

Returning to the specific example as detailed with regard to FIG. 1, the valid count registers 32 (FIG. 1) provide a "valid count in" and a "valid count out" for each window of a current display. The requisite test logic is then performed by the comparator 34 to indicate the various commands regarding "data in" and "data out" in relation to the image frame buffer 20. The comparator 34 accordingly controls the "write" sequence unit 16 and the "refresh" sequence unit 18. Through these units, image data is supplied to the display unit D and the image frame buffer 20. Also, the sections 32 of the valid data planes 26 are maintained. Note that the data "out" operation for the display of image data or background data is ultimately controlled within the display apparatus D as described in greater detail below. However, both "in" and "out" operations are deemed to be more easily perceived with a diagrammatic representation.

Figure 7:
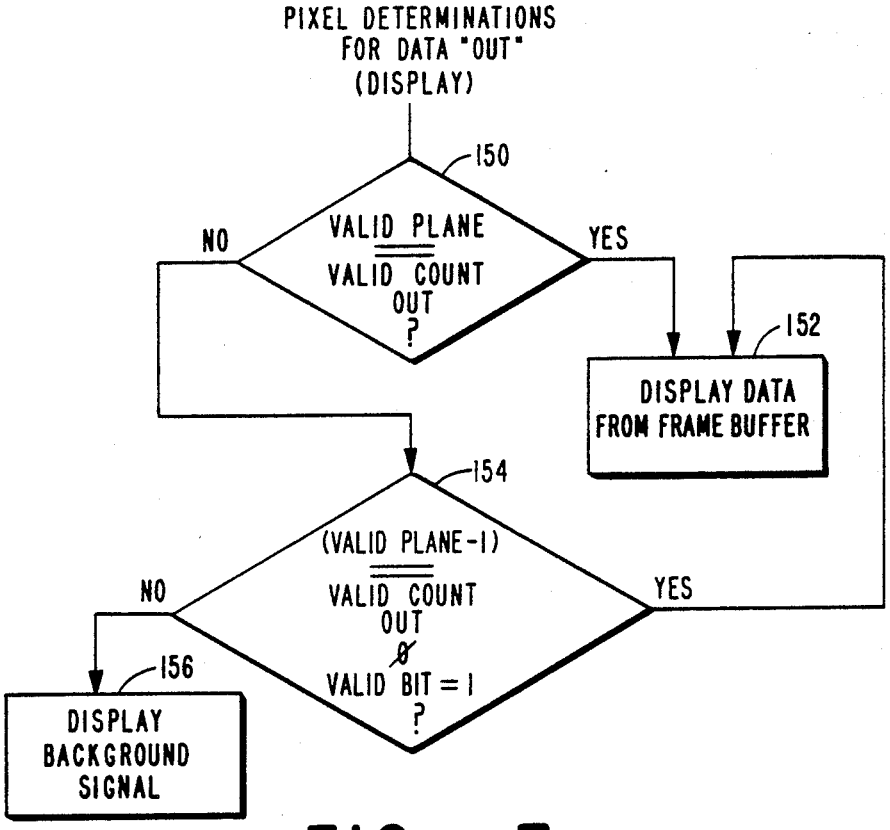
FIG. 7 is a logic diagram illustrating a display process of the system of FIG. 1.

In considering the data "out" operation (FIG. 7) the initial query is represented by a block 150, i.e. "valid plane = valid count out"? An affirmative response to the query commands the provision of display data from the image frame buffer as indicated by a block 152. That is, the block 152 indicates the provision of individual pixel data from the image buffer 20 ultimately to command a color and intensity pixel display.

A negative determination from the block 150 initiates another query as indicated by a block 154. Specifically, is "(valid plane − 1) = valid count out and valid bit = 1"? A positive result from the query again advances the process to the operation of block 152 indicating the display of data from the image frame buffer. Alternatively, a negative result from the block 154 commands the display of background signal data. That is, the color and intensity of the background within a particular window is commanded.

Figure 8:
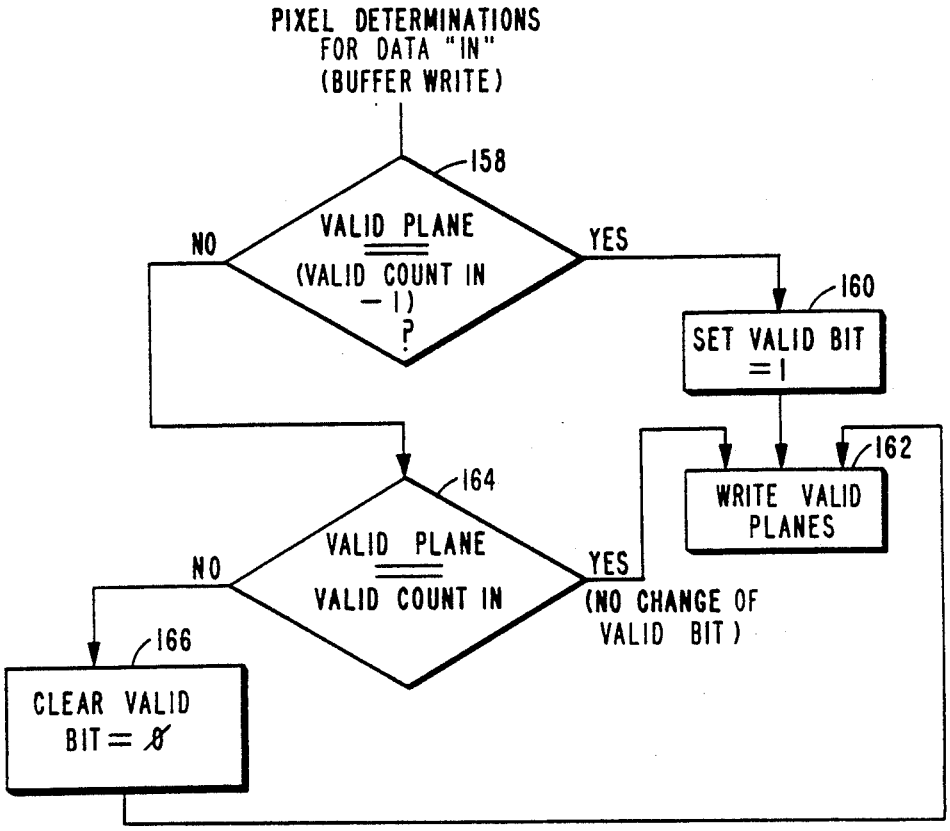
FIG. 8 is a logic diagram illustrating a rewrite process of the system of FIG. 1.

The determinations regarding data "in" on a pixel-by-pixel basis are illustrated in FIG. 8. An initial block 158 indicates the query: "valid plane = (valid count in − 1)"? An affirmative test result advances the process to block 160 and the step of, "set valid bit = 1". Subsequently, the process moves directly to the step of block 162, "write valid planes".

A negative determination from the block 158 advances the process to the query block 164 indicating: "valid plane = valid count in"?

An affirmative or "yes" result from the block 164 again advances the process to the block 162. Conversely, a negative result from the block 164 indicates a step represented by a block 166 of clearing the valid bit to zero (reset) and then advancing to the step of block 162.

The display control structure is illustrated in somewhat greater detail in FIG. 4, with a block 120 representing the valid data apparatus (valid planes 26, comparator 34 and valid bit register 36) to form the command signals as set out above for provision to a window look-up table 80 in the display unit D. In FIG. 4, the image frame buffer 20 is represented by separate blocks indicative of each side, e.g. buffer side A and buffer side B. The sides A and B are shown connected to receive address signals in lines 61 and 63 and image signals through lines 66 and 68. Such signals are provided from the picture system P through the "write" sequence unit 16 (FIG. 1). The window frame buffer 24 (FIG. 4) is illustrated to receive addresses through a line 46 as previously described.

The image buffer sides A and B are connected to a multiplexer 76 (in the display apparatus D) for supplying control data to the CRT display unit. In that regard, the multiplexer 76 supplies digital data that may be further processed to produce digital signals that drive a D-A converter to provide a signal format for driving a cathode ray tube in the apparatus D in scan sequence. These structures and their operation are well known in the prior art.

The multiplexer 76 also is connected to receive background display data through a line 78 from the window look-up table 80. Essentially, the table 80 supplies the default background color for the designated "invalid" pixels that are not supplied from image frame buffer 20. The window look-up table 80 is controlled and variously set with data by a window control engine 82 connected to receive signals from the picture system P (FIG. 1). The engine 82 has the computing capability to set up the storage of the window look-up table 80 preparatory to any specific display.

Acting through the window look-up table 80, the valid data apparatus 120 controls the multiplexer 76 through a cable 86. Accordingly, the multiplexer 76 selectively passes image data for a pixel from: the image buffer side A, the image buffer side B, or background from the window look-up table 80. The selection is controlled window-by-window and pixel-by-pixel by the window look-up table 80 which receives control data from the window frame buffer 24, the valid data apparatus 120 and the window control engine 82. Furthermore, the table 80 in conjunction with the window frame buffer 24 and the valid data apparatus 120 allow swapping between the buffer sides A and B and effective clearing of individual windows. Such operations may be executed quickly accommodating the time demands of an effective, dynamic multiple window display.

To consider an exemplary operation of supplying data to the display apparatus D, reference will again be made to FIG. 3. To perform the buffer swap function of window 33 (window code "5") from image buffer side B to side A, the window control engine 82 changes the contents of location code "5" in the window look-up table 80 to cause the multiplexer 76 to select data from the image buffer side A. Then, when the display unit screen is being refreshed, and when window 33 (window code "5") is being drawn, the window look-up table 80 causes the data from the buffer side A to be drawn.

Other windows on the screen as illustrated in FIG. 3 may independently prompt the multiplexer 76 to select either buffer side A or B as the source of image data. Accordingly, the swapping of individual window buffer sides can be done very quickly by the window control engine 82 writing only locations of the window look-up table that need to be swapped.

To consider another example, assume that an area A1 (FIG. 3B) is to be displayed. The area lies in window 31 and is specified by a window code "4". With the area addressed, the window frame buffer 24 (FIG. 4) provides the window code "4" to the window look-up table 80. The valid data apparatus 120 is addressed to identify the same area Al of the display and supplies an "invalid" signal indicating that the contents of the image frame buffer at area location A1 is to be ignored. A signal indicating that fact along with a signal indicating the window frame code "4" is supplied to the window look-up table 80. Consequently, the window look-up table responds with a signal to provide default background color in the line 78 for the display area A1.

An alternative situation involves the display of an area A2 (FIG. 3B) in the window 28 designated by the window code "3". The area A2 contains a fragment of a line drawing. Consequently, data for the display will be designated as "valid" by the valid data apparatus 120 and provided from either the image frame buffer side A or the image frame buffer side B. Of course, selection between the sides A and B is accomplished by the window look-up table 80 (previously loaded by the window control engine 82) and the multiplexer 76.

As suggested above, it is to be understood that areas as represented in FIG. 3 are grossly out of proportion; however, drawings for actual displays are simply not susceptible to proportioned representations. In that regard, note that the area A2 while representing a single pixel or area of the display is illustrated to be substantially larger than the represented portion of the display in window 28.

In view of the above, it may be seen that the system of the present invention accommodates certain specific desirable management operations with regard to the selective writing in a window of interest, clearing a window of interest, swapping a window of interest with respect to the image frame buffer, and selecting with regard to specific areas within a given window so as to provide data from either frame buffer or from a background source. It is important to appreciate that the valid data apparatus is effective to validate selective data in the image frame buffer 20. These features are detailed herein with respect to the disclosed embodiment and in that regard it is to be appreciated that there are certain key aspects of the system, as swapping with respect to window displays, the use of valid data apparatus to validate select image data in the image frame buffer, and the use of a window frame buffer to designate areas of the display with window codes. However, the scope hereof is deemed properly determined in accordance with the claims as set forth below.

What is claimed is:

1. A dynamic control system for use with a computer graphics apparatus which receives and provides image data and control signals for a scan-pattern display, comprising:

an image frame buffer means for storing pixel area image data for a display;

count means for storing a count for identifying select one of several pixel valid count states;

a storage array for storing pixel valid count representations in relation to said pixel area image data in said image frame buffer means;

comparison means for comparing signals from said count means with signals from said storage array to provide coincidence signals indicating pixel area selections; and means for controlling said image data with respect to said image frame buffer in accordance with said coincidence signals.

2. A control system according to claim 1 wherein said image frame buffer comprises a double-sided buffer with sides for alternately storing and delivering image data.

3. A control system according to claim 1 wherein said count means comprises means for providing a plurality of counts for selective comparison with said valid count representation.

4. A control system according to claim 1 wherein said storage array comprises means for storing numerical values in a sequence related to the writing of data in said image frame buffer means.

5. A control system according to claim 1 wherein said means for controlling comprises means to input data in said image frame buffer.

6. A control system according to claim 1 wherein said means for controlling comprises means to output data in said image frame buffer.

7. A system according to claim 6 wherein said means to output data comprises means for selectively supplying image data from a pixel section of said image frame buffer means or signals representative of background, determined by the contents of said storage array.

8. A system according to claim 1 further including a window frame buffer for defining plural multiple-area windows of said display and wherein said means for controlling said image data is controlled to some extent by said window frame buffer.

9. A system according to claim 8 wherein said count means stores counts for said windows defined by said window frame buffer.

10. A system according to claim 9 wherein said storage array comprises means for storing said valid count representations for said windows.

11. A control system according to claim 10 wherein said means for controlling comprises means to input data in said image frame buffer.

12. A control system according to claim 10 wherein said means for controlling comprises means to output data in said image frame buffer.

13. In a raster scanned video display apparatus having an image frame buffer which stores display data for a plurality of pixels, the improvement for attaining select different pixel displays including alternative display data, comprising:

storage means for certain of said pixels in said display for storing count signals representing alternate display selections, said storage means being associated with said image frame buffer;

test means for testing said count signals against predetermined count values to indicate a display selection;

table means for supplying said alternative display data;

multiplexer means coupled to receive display data from said image frame buffer and said table means, and controlled by said test means to provide select display data.

14. The improvement defined by claim 13 further including a window frame buffer for storing window signals defining windows in said displays including alternate display data, said window frame buffer being associated with said image frame buffer, said multiplexer further receiving signals from said window frame buffer to provide select display data.

15. A method of displaying a dynamic display from image data comprising the steps of:

defining said display in terms of pixels;

selectively registering display image data for said pixels;

registering count values for said pixels;

testing said count values for said pixels against a current valid count to provide a display selection signal;

providing alternate display image data; and selecting for display said registered display image data or said alternate display image data under control of said display selection signal.

16. A dynamic control system for use with a computer graphics apparatus which provides image data and control signals for a scan-pattern display, comprising:

an image frame buffer means for storing pixel area image data for said scan-pattern display;

count means for storing a count for identifying select ones of several pixel valid count states;

a storage array for pixel valid count representations in relation to said pixel area image data in said image frame buffer means;

comparison means for comparing signals from said count means with signals from said storage array to provide coincidence signals indicating pixel area selections;

means for writing data in said image frame buffer and related counts in said storage array, for select pixels including a fraction of said pixels designated for background display; and means for providing data from said image frame buffer under control of said coincidence signals.

17. A system according to claim 16 further including a source of background pixel data and further including means for providing said background pixel data under control of said comparison means.

* * * * *

UNITED STATES PATENT AND TRADEMARK OFFICE

CERTIFICATE OF CORRECTION

PATENT NO. : 5,061,919

DATED : October 29, 1991

INVENTOR(S) : Gary S. Watkins

It is certified that error appears in the above-identified patent and that said Letters Patent is hereby corrected as shown below:

Column 1, Line 5 delete "MANNER" and add --MATTER--.

Signed and Sealed this

Twenty-third Day of March, 1993

*Attest:*

STEPHEN G. KUNIN

*Attesting Officer*

*Acting Commissioner of Patents and Trademarks*